United States Patent [19]

Zunkel

[11] Patent Number: 4,877,086

[45] Date of Patent: Oct. 31, 1989

[54] PRESSURE LIMITER FOR A DOWNHOLE PUMP AND TESTING APPARATUS

[75] Inventor: Gary D. Zunkel, Chickasha, Okla.

[73] Assignee: Halliburton Company, Duncan, Okla.

[21] Appl. No.: 247,122

[22] Filed: Sep. 20, 1988

[51] Int. Cl.[4] ..... E21B 34/06; E21B 47/00

[52] U.S. Cl. ..... 166/106; 166/187; 166/191; 166/321; 166/326

[58] Field of Search ..... 166/321, 319, 326, 373, 166/106, 187, 191

[56] References Cited

U.S. PATENT DOCUMENTS

| | | | |
|---|---|---|---|
| 2,690,224 | 9/1954 | Roberts | 166/120 |
| 3,083,774 | 4/1963 | Peters et al. | 166/187 |
| 3,291,219 | 12/1966 | Nutter | 166/145 |
| 3,439,740 | 4/1969 | Conover | 166/250 |
| 3,853,177 | 10/1974 | Mott | 166/187 |
| 3,876,000 | 4/1975 | Nutter | 166/106 |
| 3,876,003 | 4/1975 | Kisling, III | 166/250 |
| 3,887,007 | 6/1975 | Abney et al. | 166/319 |
| 3,926,254 | 12/1975 | Evans et al. | 166/106 |
| 4,246,964 | 1/1981 | Brandell | 166/106 |
| 4,313,495 | 2/1982 | Brandell | 166/53 |
| 4,320,800 | 3/1982 | Upchurch | 166/106 |
| 4,366,862 | 1/1983 | Brandell | 166/106 |
| 4,372,387 | 2/1983 | Brandell | 166/334 |
| 4,386,655 | 6/1983 | Brandell | 166/106 |
| 4,388,968 | 6/1983 | Brandell | 166/236 |
| 4,412,584 | 11/1983 | Brandell | 166/169 |
| 4,457,367 | 7/1984 | Brandell | 166/105 |
| 4,458,752 | 7/1984 | Brandell | 166/187 |
| 4,729,430 | 3/1988 | White et al. | 166/106 |

OTHER PUBLICATIONS

Halliburton Hydroflate Packers Assembly-Operation-Maintenance Manual No. 610.6051, Halliburton Services.

Northstar Drilling Tester, Ltd., Tool String Shown on Page 11 of the Sep. 1, 1980, Edition of Oil Week.

Lynes Product No. 302-40, pp. 3964-3966 of Lynes Catalog.

Johnston/Schlumberger Form J-432.

*Primary Examiner*—Jerome W. Massie, IV

*Assistant Examiner*—Terry L. Melius

*Attorney, Agent, or Firm*—Neal R. Kennedy; Mark E. McBurney

[57] ABSTRACT

A pressure limiter for use with a positive displacement pump and an inflatable packer. The pressure limiter includes an outer housing with an inner mandrel disposed therein. Slidably disposed between the mandrel and housing is a generally annular piston. A spring biases the piston toward a closed position. Packer pressure acts upwardly on the piston tending to move it to an open position in which pump discharge pressure is relieved to a well annulus. A check valve prevents premature relief of pressure of the packer. Once the piston is in an open position, packer pressure will maintain it in the open position until pressure is relieved from the packer.

18 Claims, 3 Drawing Sheets

PRESSURE LIMITER FOR A DOWNHOLE PUMP AND TESTING APPARATUS

BACKGROUND OF THE INVENTION

1. Field of the Invention

This invention relates to downhole testing apparatus having pumps having pressure limiters and for pumping fluid to inflatable packers, and more particularly, to a pressure limiter which vents to a well annulus and is maintained in an open position until the packers are deflated.

2. Description of the Prior Art

A known method of testing a well formation is to isolate the formation between a pair of inflatable packers with a flow port therebetween adjacent the formation. The packers are inflated by means of a pump in the testing string which pumps well annulus fluid or mud into the packers to place them in sealing engagement with the well bore.

Typically, positive displacement pumps are used. U.S. Pat. No. 4,246,694 to Brandell discloses a rotationally operated pump having a plurality of vertically reciprocating pistons which are driven by a cam structure. A simpler, sleeve-type pump piston is used in the downhole pump of Evans et al., U.S. Pat. No. 3,926,254. Both of these patents are assigned to the assignee of the present invention.

When using these or other pumps for inflating the packers, it is essential that the packers not be overinflated and damaged. One method of limiting the inflation pressure uses a torque limiter. As the work string is rotated to operate the pump and increase the pressure therein, the torque required to operate the pump also increases. When the torque exceeds a predetermined level, the torque limiter is engaged which allows the entire pump to rotate so that it will no longer pump liquid.

Another method utilizes a type of pressure limiter having a spring biased differential piston which, when engaged, engages a set of lugs which allows the bottom of the pump to be held stationary while the top is rotated by the work string so that the pump will operate. When the pump pressure exceeds the spring force acting on the differential piston, the lugs are disengaged which allows the entire pump to rotate so that it no longer pumps. With either of these two methods of limiting inflation pressure, a set of lugs is engaged or disengaged which may be inconsistent in their operation. A large amount of friction results when the lugs are engaged or disengaged, and any side load resulting from a deviated hole also increases the friction. It is therefore desirable to develop a pressure limiter which does not present these frictional difficulties.

U.S. Pat. No. 4,313,495 to Brandell, assigned to the assignee of the present invention, utilizes a clutch which is disengaged when the pump pressure reaches a predetermined level, thus making the pump inoperative. Again, there are frictional limitations with such a system. The present invention which utilizes a sleeve-like relief valve bypasses pump discharge liquid to the well annulus. Continued rotation of the tool string in operation of the pump merely circulates the fluid. No frictionally hindered members are present.

The pressure limiter of White et al. disclosed in U.S. Pat. No. 4,729,430, assigned to the assignee of the present invention, limits packer pressure internally and does not vent fluid therein to the well annulus. In some embodiments of this apparatus, a reciprocating sleeve-like piston increases the pumping chamber volume in response to the displacement of the pump. While this is desirable in some situations, the apparatus is considerably more complex than the pressure limiter of the present invention. The present pressure limiter may also be utilized with any number of previously known positive displacement pumps.

SUMMARY OF THE INVENTION

The pressure limiter of the present invention is adapted for use in a tool string having a pump and an inflatable packer. The pressure limiter comprises housing means for positioning in the tool string between the pump and packer, the housing means defining a central opening therethrough and an outlet in communication with the central opening, mandrel means for positioning in the central opening of the housing means, port means on the housing means in communication with a discharge portion of the pump for providing a flow path in the housing means, valve means disposed between the housing means and mandrel means for providing communication between the port means and the outlet when in an open position in response to an outlet pressure of the pump, the outlet means further having a closed position, and biasing means for biasing the valve means toward the closed position. The apparatus preferably further comprises means for preventing premature relief of pressure on the packer. This means for preventing premature relief of packer pressure may be characterized by check valve means for allowing flow of fluid from the pump to the packer and preventing reverse fluid flow, such that the packer pressure is maintained on a portion of the valve means.

The valve means defines a differential area thereon against which pump discharge pressure acts, and this differential area is preferably defined by the difference between lower and upper substantially annular areas on the valve means. In one embodiment, the valve means may be characterized by a piston movable to an open position in response to the pump discharge pressure, this open position being such that the outlet of the housing means is in communication with the pump outlet whereby fluid pumped from the pump is bypassed through the outlet of the housing means.

The port means comprises an annular portion in the housing means defining a port therethrough. When the valve means is in an open position, this port is in fluid communication with the outlet of the housing means.

The pressure limiter may further comprise first sealing means on the valve means, for sealing between the valve means and the mandrel means and between the valve means and the housing means for preventing communication between the packer and the outlet of the housing means, and second sealing means on the valve means for sealing between the port means and the outlet of the housing means when the valve means is in the closed position. The first sealing means is on one side of the housing means outlet, and the second sealing means is on an opposite side of the housing means outlet from the first sealing means.

The mandrel means preferably comprises an inner mandrel and a flow tube disposed in the inner mandrel such that a fluid passage is defined therebetween for directing fluid to a portion of the valve means opposite the biasing means. The biasing means may be characterized by a spring engaged with the valve means and the housing means. Preferably, the biasing force is adjustable, such as by varying the length of the spring with spacer means.

Stated another way, the present invention includes a downhole tool comprising a pump, an inflatable packer disposed below the pump and adapted for inflation thereby, and a pressure limiter disposed between the pump and packer, the pressure limiter comprising means for bypassing pump discharge pressure to a well annulus above the packer, when the pump discharge pressure reaches a predetermined level, and means for maintaining the pressure limiter in a bypassing position such that an outlet of the pump is in substantially constant communication with the well annulus until pressure is relieved from the packer. The means for bypassing comprises an annular piston in the pressure limiter which is biased toward a closed position, the piston having a differential area thereon against which the pump pressure acts for overcoming a biasing force on the piston when the predetermined pressure level is reached. The means for maintaining the pressure limiter in a bypassing position comprises a check valve adjacent the piston whereby pressure is maintained on the differential area at a level substantially as high as the predetermined level, even when the pump discharge pressure drops as a result of being bypassed to the well annulus.

An important object of the invention is to provide a pressure limiter for a positive displacement pump in a well testing apparatus.

Another object of the invention is to provide a pressure limiter which bypasses pump discharge fluid to a well annulus.

An additional object of the invention is to provide a pressure limiter which is maintained in an open position until inflatable packers are deflated.

A further object of the invention is to provide a well testing apparatus having a positive displacement pump, inflatable packers and a pressure limiter for preventing overinflation of the packers.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1A:
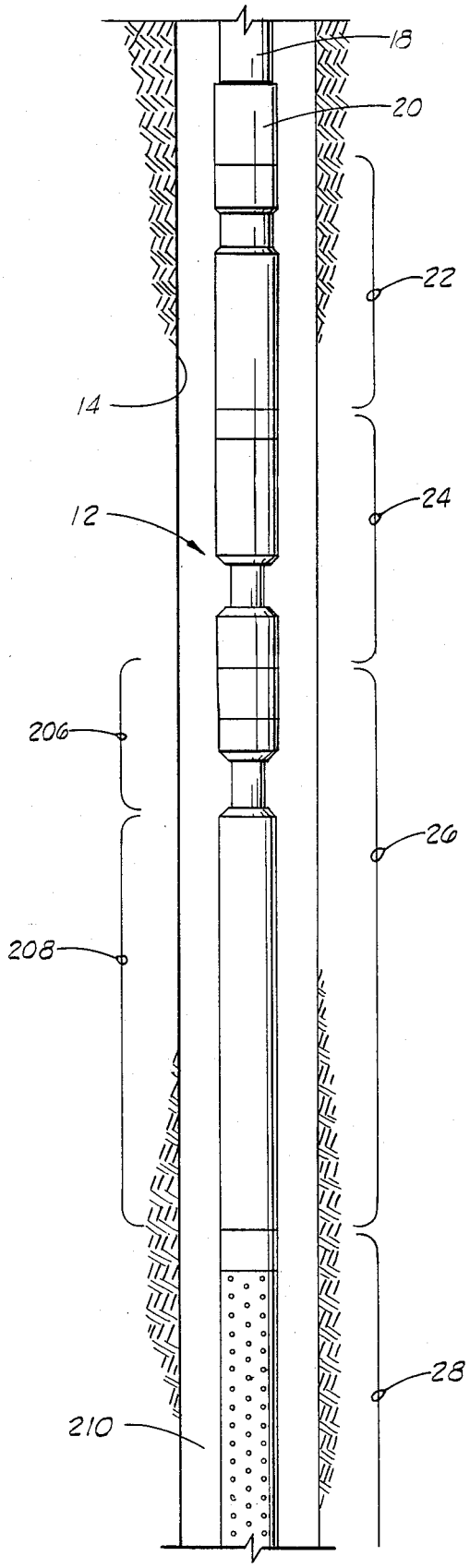
FIGS. 1A–1B show the pressure limiter of the present invention in a well testing apparatus positioned in a well bore for testing a well formation.
Figure 1B:
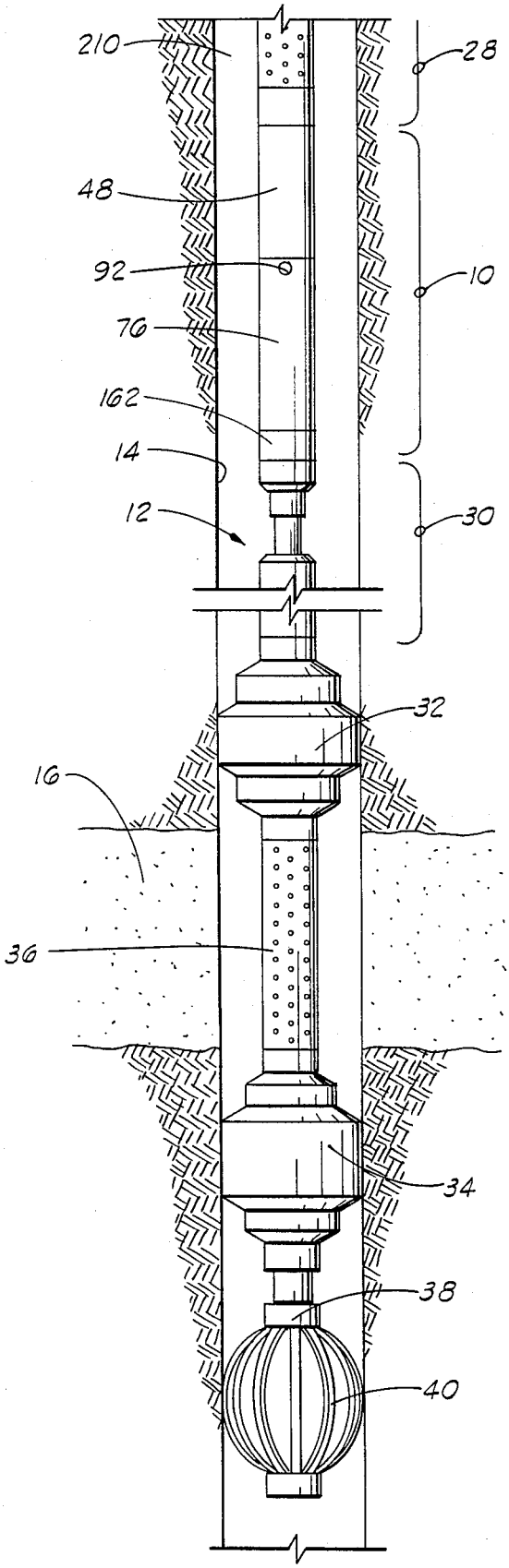

Referring now to the drawings, and more particularly to FIGS. 1A–1B, the pressure limiter of the present invention is shown and generally designated by the numeral 10 forming a part of a testing string or tool 12. Testing string 12 is shown in position in a well bore 14 for use in testing a well formation 16. Testing string 12 is attached to the lower end of a tool string 18 and includes a reversing sub 20, a testing valve 22 such as the Halliburton Hydrospring® tester, and an extension joint 24.

A positive displacement pump 26, such as that disclosed in U.S. Pat. No. 4,246,964 to Brandell, assigned to the assignee of the present invention, is positioned below extension joint 24. Other positive displacement pumps could also be used. A screen assembly 28 of a kind also disclosed in the patent to Brandell, extends downwardly from pump 26 and is thus positioned above pressure limiter 10.

Positioned below pressure limiter 10 is a safety joint 30, such as the Halliburton Hydroflate® safety joint. An upper packer 32 is attached to the lower end of safety joint 30 and is disposed above formation 16. A lower packer 34 is positioned below well formation 16. A porting sub 36 interconnects upper packers 32 and lower packer 34. An equalizing tube and spacers (not shown) may also be used between upper packer 32 and lower packer 34 depending upon the longitudinal separation required therebetween.

Upper packer 32 and lower packer 34 are also of a kind generally known in the art such as the Halliburton Hydroflate® packers. Upper packer 32 and lower packer 34 are inflatable by pump 26 in a manner hereinafter described such that the packers may be placed in sealing engagement with well bore 14, thus isolating well formation 16 so that a testing operation may be carried out.

A gauge carrier 38 is attached to the lower end of lower packer 34 and includes a plurality of drag springs 40 which are adapted to engage well bore 14 and prevent rotation of a portion of testing string 12 during inflation of upper packer 32 and lower packer 34.

Figure 2A:
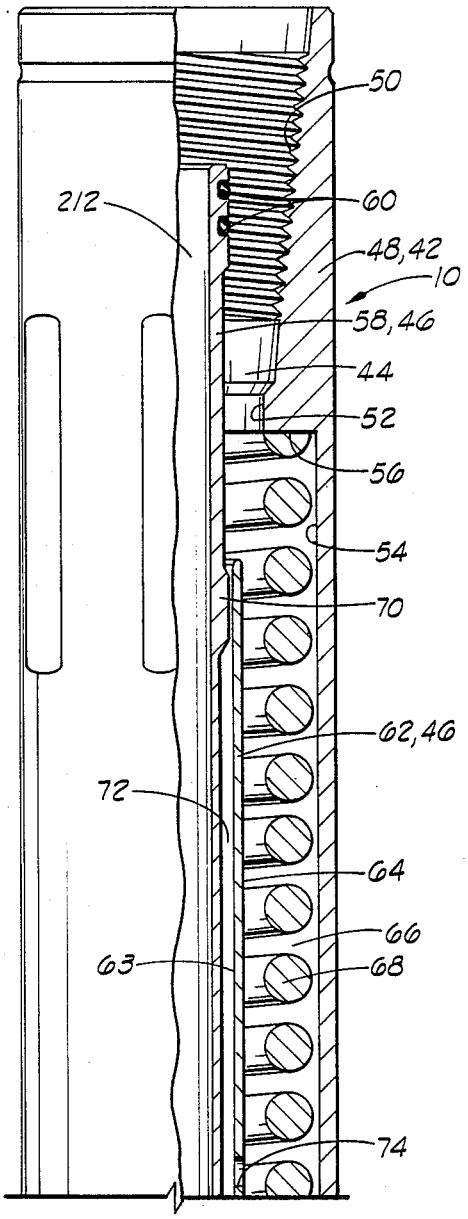
FIGS. 2A–2C show a partial longitudinal cross section of the pressure limiter.
Figure 2B:
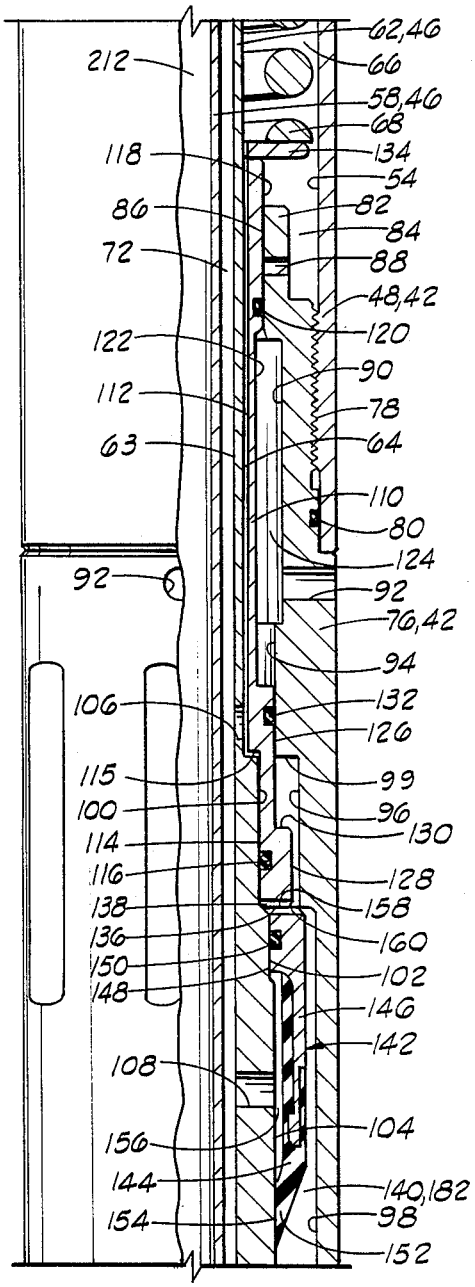
Figure 2C:
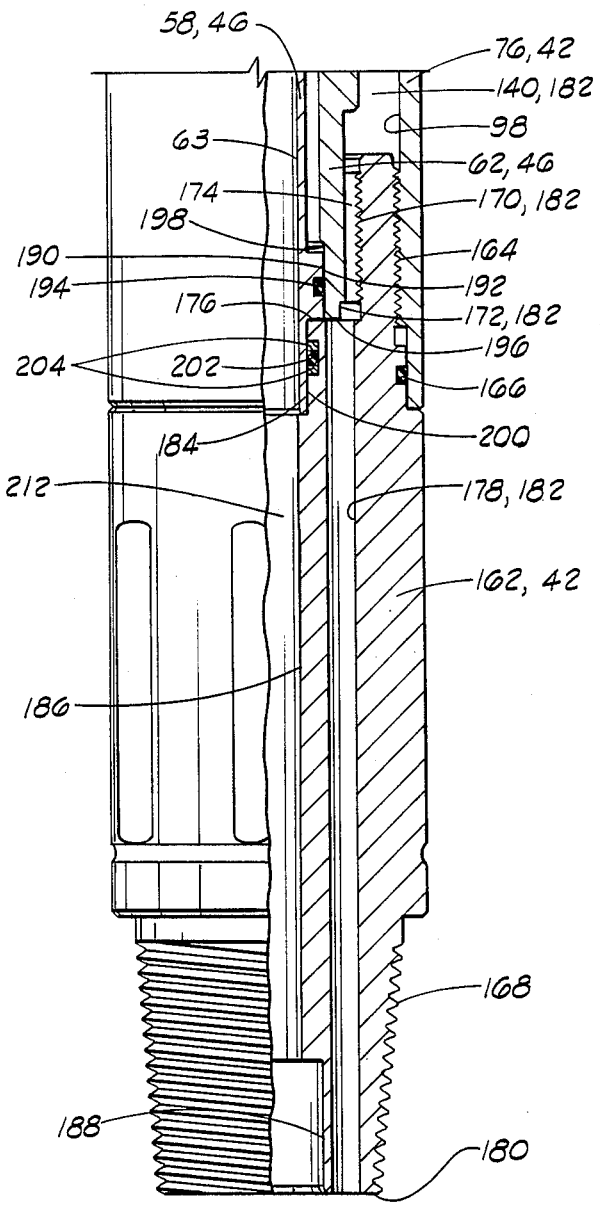

Referring now to FIGS. 2A–2C, the details of pressure limiter 10 are shown. Pressure limiter 10 generally includes housing means 42 defining a longitudinally central opening 44 therethrough. Positioned in central opening of housing means 42 is a mandrel means 46.

As seen in FIG. 2A, housing means 42 includes at its upper end a top coupling 48 with an internally threaded upper end 50 adapted for attachment to an upper portion of testing string 12 above pressure limiter 10. Top coupling 48 has a first bore 52 and a larger second bore 54. A downwardly facing, annular shoulder 56 extends between first and second bores 52 and 54.

Mandrel means 46 comprises an inner flow tube 58, a portion of which forms the upwardmost portion of the mandrel means. Sealing means, such as O-rings 60, are provided at the upper end of inner flow tube 58 for sealing engagement with a corresponding tube portion of the portion of testing string 12 above pressure limiter 10 in a manner known in the art.

Also comprising a portion of mandrel means 46 is an inner mandrel 62 which is disposed generally annularly around inner flow tube 58. Inner mandrel 62 has a first bore 63 therein and a first outside diameter 64 which is spaced radially inwardly from second bore 54 of top coupling 48 such that an annular volume 66 is defined therebetween. Disposed in annular volume 66 is a biasing means, such as spring 68. It will be seen that the upper end of spring 68 bears against shoulder 56 in top coupling 48.

At a position below O-rings 60, inner flow tube 58 has an enlarged portion 70 which is in close, spaced relationship to first bore 63 of inner mandrel 62. It will be seen that a generally annular volume 72 is formed between inner flow tube 58 and first bore 63 of inner mandrel 62. An upper port 74 in inner mandrel 62 provides communication between annular volume 66 and annular volume 72.

Referring now to FIG. 2B, the lower end of top coupling 48 is connected to a piston housing 76 at threaded connection 78. Sealing means, such as O-ring 80, provide sealing engagement between top coupling 48 and piston housing 76. It will be seen that piston housing 76 forms another portion of housing means 42.

Piston housing 76 has a generally annular upper end 82 which is spaced radially inwardly from second bore 54 in top coupling 48 such that an annular volume 84 is defined therebetween. It will be seen that annular volume 84 is in communication with annular volume 66. Annular upper end or portion 82 defines a first bore 86 in piston housing 76, and has at least one substantially transverse port 88 therethrough extending from first bore 86 to annular volume 84.

Below first bore 86, piston housing 76 has a second bore 90, and at least one transverse port 92 extends through piston housing 76 to provide communication between second bore 90 and the exterior of pressure limiter 10. Port 92 will thus be seen to be an outlet 92 of housing means 42. Second bore 90 is larger than first bore 86. A third bore 94 extends below second bore 90 in piston housing 76. Third bore 94 is smaller than second bore 90, but is larger than first bore 86. This dimensional relationship between first bore 86 and third bore 94 will become more apparent herein. Piston housing 76 also defines progressively larger fourth and fifth bores 96 and 98 below third bore 94. A downwardly facing shoulder 99 extends between third bore 94 and fourth bore 96.

Still referring to FIG. 2B, inner mandrel 62 has a second outside diameter 100, a third outside diameter 102 and a fourth outside diameter 104 which are below first outside diameter 64 thereof. These outer surfaces are progressively larger from first outside diameter 64 to fourth outside diameter 104.

Inner mandrel 62 defines at least one intermediate transverse port 106 therethrough which provides communication between annular volume 72 and the lower end of first outside diameter 64. At least one lower transverse port 108 is also defined in inner mandrel 62. Lower port 108 provides communication between annular volume 72 and fourth outside diameter 104 of the inner mandrel. It will be seen that inner flow tube 58 extends through the entire portion of first bore 63 of inner mandrel 62 shown in FIG. 2B, and thus annular volume 72 extends through this portion as well.

Annularly positioned between housing means 42 and mandrel means 46 is a differential piston or valve means 110, characterized in the preferred embodiment as a differential piston 110. Piston 110 has a first bore 112 which is preferably spaced radially outwardly from first outside diameter 64 of inner mandrel 62. Below first bore 112 in piston 110 is a larger, second bore 114 adapted for close, sliding engagement with second outside diameter 100 of inner mandrel 62. A downwardly facing shoulder 115 extends between first bore 112 and second bore 114 on piston 110. An outer sealing means, such as O-ring 116, provides sliding, sealing engagement between piston 110 and inner mandrel 62. This outer sealing means may be characterized as a portion of a first or lower sealing means on valve means 110. Piston 110 has a first outside diameter 118 which is adapted for close, sliding relationship with first bore 86 in annular upper end 82 of piston housing 76. An outer sealing means, such as O-ring 120, provides sliding, sealing engagement between first bore 86 of piston housing 76 and first outside diameter 118 of piston 110. The outer sealing means may also be referred to as a second or upper sealing means on valve means 110. Thus, sealing is provided between piston 110 and piston housing 76 at a longitudinal location above port 92 in the piston housing. Piston 110 is shown in a closed position in FIG. 2B, and in this position, it will be seen that the sealing means of O-ring 120 is below port 88 in upper end 82 of piston housing 76.

Piston 110 has a second outside diameter 122 which is preferably smaller than first outside diameter 118 thereof. Second outside diameter 122 of piston 110 and second bore 90 of piston housing 76 generally form an annular volume 124 which is in communication with port or outlet 92 in the piston housing.

Piston 110 has a third outside diameter 126 and a fourth outside diameter 128. An upwardly facing annular shoulder 130 extends between third and fourth outside diameters 126 and 128. It will be seen that shoulder 130 on piston 110 generally faces shoulder 99 in piston housing 76 and is spaced downwardly therefrom when piston 110 is in the closed position shown in FIG. 2B. Third outside diameter 126 of piston 110 is adapted for close, sliding relationship with third bore 94 of piston housing 76. Thus, it will be seen that third outside diameter 126 is larger than first outside diameter 118 of piston 110.

A lower, outer sealing means, such as O-ring 132, provides sliding, sealing engagement between third outside diameter 126 of piston 110 and third bore 94 of piston housing 76. This sealing means may be characterized as another portion of the first sealing means on valve means 110, and the sealing means provided by O-ring 132 is always below port 92 in piston housing 76.

An annular spring spacer 134 is positioned around first outside diameter 64 of inner mandrel 62 and engages the upper end of piston 110. Spring spacer 134 acts as a seat for the lower end of spring 68, and because spring 68 is always adapted to be in compression when pressure limiter 10 is assembled, it will be seen that spring 68 acts as a biasing means for biasing piston means 110 toward its closed position. The number of spacers 134 may be varied to adjust the working height, and thus the force exerted by, spring 68.

Lower end 136 of piston 110 has a recess 138. As will be further discussed herein, recess 138 insures that fluid pressure is free to act on lower end 136 of the piston.

An annular volume 140 is defined between third and fourth outside diameters 102 and 104 of inner mandrel 62 and fifth bore 98 of piston housing 76, and thus annular volume 140 is generally below piston means 110. Disposed in annular volume 140 is a check valve means, generally designated by the numeral 142. Check valve means 142 is provided for allowing fluid to pass from annular volume 72 through port 108 into annular volume 140, while preventing reverse flow, in a manner hereinafter described. Check valve means 142 preferably comprises a resilient valve portion 144 carried by a valve portion carrier 146. Valve portion carrier 146 has a bore 148 which is in close relationship to third outside diameter 102 of inner mandrel 62. Sealing means, such as O-ring 150, provides sealing engagement between valve portion carrier 146 and inner mandrel 62.

Valve portion 144 has a resilient annular lip 152 having a radially inner surface 154 that is sealingly engaged against fourth outside diameter 104 of inner mandrel 62. Valve portion 144 is further configured such that an annular space 156 is defined between valve portion 144 and inner mandrel 62. It will be seen that annular space 156 is in communication with port 108 in inner mandrel 62, and thus in communication with annular volume 72.

An upper end 158 of valve carrier portion 146 is engaged with lower end 136 of piston 110 when the piston is in the closed position shown in FIG. 2B. Upper end 158 of valve carrier portion 146 has a recess 160 therein which insures communication between annular volume 140 and recess 138 on piston 110. It will thus be seen by those skilled in the art that any fluid pressure in annular volume 140 will act upwardly on lower end 136 of piston 110.

Referring now to FIG. 2C, the lower end of piston housing 76 is connected to a bottom nipple 162 at threaded connection 164. Sealing means, such as O-ring 166, provides sealing engagement between piston housing 76 and bottom nipple 162. Bottom nipple 162 forms the lower portion of housing means 42 and has an externally threaded surface 168 for connection to components of testing string 12 below pressure limiter 10.

The lower end of inner mandrel 62 of mandrel means 46 is connected to bottom nipple 162 of housing means 42 at threaded connection 170. Below threaded connection 170 is an annular recess 172. A longitudinal notch 174 extends along the threaded portion of the lower end of inner mandrel 62 such that communication is provided between annular volume 140 and annular recess 172.

Bottom nipple 162 has an upwardly facing shoulder 176 therein below threaded connection 170 and adjacent recess 172 on inner mandrel 62. A longitudinal hole 178 extends through bottom nipple 162 from shoulder 176 to lower end 180 of the bottom nipple. As will be seen by those skilled in the art, hole 178 is in communication with recess 172 on inner mandrel 62, and thus in communication with annular volume 140 between inner mandrel 62 and piston housing 76. Thus, a passageway means 182 is provided between check valve means 142 and the bottom of housing means 42. Passageway means 182 is in communication with corresponding passageways in testing apparatus 12 and forms a portion of an inflation passage to upper and lower packers 32 and 34.

Bottom nipple 162 has a first bore 184, a second bore 186 and a third bore 188. Third bore 188 is adapted to sealingly receive a portion of testing string 12 below pressure limiter 10, in a manner known in the art.

Below first bore 63 at the lower end of inner mandrel 62 is a slightly enlarged second bore 190. The lower end of inner flow tube 58 has an enlarged diameter portion 192 in close, spaced relationship to bore 190 in inner mandrel 62. Sealing means, such as O-ring 194, provides sealing engagement between inner flow tube 58 and inner mandrel 62. A lower end 196 of inner mandrel 62 is engaged with shoulder 176 in bottom nipple 162. It will be seen that enlarged diameter portion 192 of inner flow tube 58 is thus longitudinally positioned between shoulder 176 and bottom nipple 162 and a small shoulder 198 in inner mandrel 62.

Below enlarged diameter portion 192, inner flow tube 58 has a smaller diameter 200 which is in close relationship with first bore 184 and bottom nipple 162. Sealing means, such as O-ring 202 with back-up seals 204, provide sealing engagement between inner flow tube 58 and bottom nipple 162.

A study of FIG. 2C will show that mandrel means 46 is connected to housing means 42 such that the longitudinal relationship therebetween is relatively fixed.

OPERATION OF THE INVENTION

Referring again to FIGS. 1A and 1B, testing string 12 is lowered into well bore 14 and positioned such that porting sub 36 is adjacent formation 16. Upper packer 32 is thus above formation 16, and lower packer 34 is below the formation.

Pump 26 has an upper portion 206 which is connected to extension joint 24 and thus rotatable with tool string 18. Upper portion 206 of pump 26 is rotatable with respect to a lower portion 208 thereof, and lower portion 208 is prevented from rotating by the engagement of drag springs 40 with well bore 14 below formation 16. To operate pump 26, tool string 18 is rotated which rotates upper portion 206 of the pump while lower portion 208 is held stationary. As previously indicated, pump 26 is of a kind known in the art such as that disclosed in U.S. Pat. No. 4,246,964 to Brandell, assigned to the assignee of the present invention, a copy of which is incorporated herein by reference. The details of pump 26 not directly discussed herein are not necessary for the purposes of this disclosure or an understanding of pressure limiter 10 of the present invention. Further, it should be understood that pressure limiter 10 may be used with different positive displacement pumps other than that disclosed in the Brandell patent.

Rotation of upper portion 206 of pump 26 causes fluid from a well annulus 210 to be drawn into screen assembly 28 and pumped downwardly through testing string 12 to pressure limiter 10. Fluid pumped from pump 26 enters pressure limiter 10 and enters the pressure limiter through central opening 44 between mandrel means 46 and housing means 42 as seen in FIG. 2A. The pumped fluid does not enter central flow passage 212 which extends longitudinally through mandrel means 46. It will be seen that pumped fluid enters annular volume 66 between inner mandrel 62 and top coupling 48, and thus is in communication with port 88 in upper end 82 of piston housing 46. Upper port 74 and intermediate port 106 in inner mandrel 62 insure that annular volume 66 and 84 fill with liquid. Fluid is pumped downwardly through annular volume 72 and into annular volume 140 through port 108 in inner mandrel 62, annular space 156 and past check valve means 142. It will be seen that check valve means 142 prevents reverse flow from annular volume 140 into annular volume 72. The fluid is pumped downwardly through passageway means 182 in a manner generally known in the art to inflate upper and lower packers 32 and 34 such that they are in sealing engagement with well bore 14, thus isolating well formation 16.

Pressure limiter 10 is included in testing string 12 so that packers 32 and 34 cannot be overinflated. Referring now to FIG. 2B, it will be seen that packer pressure is present in annular volume 140, and when piston 110 is in the closed position shown, packer pressure and pump pressure, which is the pressure in annular volume 66, are substantially the same.

Packer pressure in annular volume 140 is exerted upwardly on lower end 136 of piston 110. As previously described, this is insured because recess 138 in piston 110 and facing recess 160 in valve portion carrier 146 of check valve means 142 prevent any sealing between the piston and the check valve means. It will be seen by those skilled in the art that packer pressure also acts downwardly on shoulder 130 of piston 110, but the result is a net upwardly acting force due to the packer pressure. In other words, third outside diameter 126 and second bore 114 of piston 110 define an annular area against which packer pressure acts upwardly.

Pump pressure in annular volume 66 acts downwardly on piston 110, and it will be seen by those skilled in the art that pressure also acts upwardly on shoulder 115 of the piston. First outside diameter 118 of piston 110 is at least as large as second bore 114 of the piston, and thus there is a net downwardly acting force on the piston due to the pump pressure in annular volume 66. However, because third outside diameter 126 of piston 110 is larger than first outside diameter 118 of the piston, as previously mentioned herein, it will be seen by those skilled in the art that there is a total net upward force on piston 110 acting on an annular area defined between third outside diameter 126 and first outside diameter 118, even when packer pressure in annular volume 140 is equal to pump pressure in annular volume 66.

As previously discussed herein, the downward biasing force exerted by spring 68 on piston 110 is predetermined and adjusted by spacer 134, and when the upward force exerted by packer pressure acting upwardly on piston 110 exceeds the biasing force, piston 110 will be moved upwardly within piston housing 76. The maximum upward movement of piston 110 is limited by the engagement of shoulder 130 on the piston with shoulder 99 in piston housing 76.

Initially, as already described, O-ring 120 is below port 88 in upper end 82 of piston housing 76, but as piston 110 is moved upwardly to its uppermost position, O-ring 20 is moved above port 88. When this occurs, it will be seen that annular volume 84 will be placed in communication with annular volume 124 through port 88 because second outside diameter of piston 110 is smaller than first bore 86 in piston housing 76. It will also be seen that annular volume 66 is thus placed in communication with well annulus 210 through port 92. When this occurs, the discharge of pump 26 is thus in communication with well annulus 210, and the pressure in annular volume 66 and the pump discharge is reduced to that in well annulus 210. In other words, the pump inlet pressure and discharge pressure are essentially equalized. Thus, upper end 82 of piston housing 76, and port 88 therein, form one embodiment of a port means for providing a flow path in housing means 42 between the discharge portion of pump 26 and outlet 92 of the housing means. Check valve means 142 in pressure limiter 10 prevents loss of packer pressure in annular volume 140, thus preventing premature deflation of packers 32 and 34.

Packers 32 and 34 may be deflated by actuation of tool string 12 in a manner known in the art, but until this has occurred, packer pressure is maintained on the bottom of piston 110 in pressure limiter 10, thereby holding the piston in its uppermost, open position. It will be seen by those skilled in the art that pressure limiter 10 will remain in its open position, and cannot be reclosed, until packer pressure in annular volume 140 has been relieved. The pressure in packers 32 and 34 is relieved by manipulation of tool string 12 in a manner known in the art. Once the pressure in packers 32 and 34 has been relieved such that they can deflate and disengage from well bore 14, the packer pressure and annular volume 140 will also be relieved. Once the pressure in annular volume 140 has been reduced to substantially the same level as that in well annulus 210, spring 68 will reclose piston 110, thus reclosing pressure limiter 10 for reuse.

It can be seen, therefore, that the pressure limiter of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A pressure limiter for use in a tool string having a pump and an inflatable packer, said pressure limiter comprising:

housing means for positioning in said tool string between said pump and packer, said housing means defining a central opening therethrough and an outlet to the annulus of the well in communication with said central opening;

mandrel means for positioning in said central opening of said housing means;

port means on said housing means in communication with a discharge portion of said pump for providing a flow path in said housing means;

valve means disposed between said housing means and mandrel means for providing communication between said port means and said outlet when in an open position in response to an outlet pressure of said pump, said valve means further having a closed position; and biasing means for biasing said valve means toward said closed position.

2. The apparatus of claim 1 further comprising means preventing premature relief of pressure on said packer.

3. The apparatus of claim 2 wherein said means for preventing premature relief of packer pressure is characterized by check valve means for allowing flow of fluid from said pump to said packer and preventing reverse fluid flow, such that packer pressure is maintained on a portion of said valve means.

4. The apparatus of claim 1 wherein said valve means defines a differential area thereon against which pump discharge pressure acts.

5. The apparatus of claim 4 wherein said differential area is defined by the difference between lower and upper substantially annular areas on said valve means.

6. The apparatus of claim 1 wherein said port means comprises an annular portion in said housing means defining a port therethrough.

7. The apparatus of claim 1 further comprising sealing means on said valve means for sealing between said port means and outlet when said valve means is in said closed position.

8. The apparatus of claim 1 further comprising sealing means on said valve means for sealing between said valve means and said mandrel means and between said valve means and said housing means for preventing communication between said packer and said outlet in said housing means.

9. The apparatus of claim 1 wherein said mandrel means comprises:

an inner mandrel; and a flow tube disposed in said inner mandrel such that a fluid passage is defined therebetween for directing fluid to a portion of said valve means opposite said biasing means.

10. A pressure limiter for a pump used to inflate an inflatable packer, said pressure limiter comprising:

a housing connectable to said pump and packer and defining a central opening therethrough with a housing outlet to the annulus of the well in communication with said central opening;

a mandrel disposed in said housing and connectable to said pump and packer such that a flow passage is defined from said pump to said packer;

a piston annularly disposed between said mandrel and said housing and in communication with said flow passage, said piston being movable to an open position in response to pump discharge pressure, said open position being such that said housing outlet is in communication with a pump outlet whereby fluid pumped by said pump is bypassed through said housing outlet, said piston further having a closed position; and check valve means for controlling flow through said flow passage and maintaining packer pressure on said piston for holding said piston in said open position.

11. The apparatus of claim 10 further comprising:

first sealing means for sealing between said piston and said housing on one side of said housing outlet; and second sealing means for sealing between said piston and said housing on an opposite side of said housing outlet from said first sealing means when said piston is in said closed position.

12. The apparatus of claim 11 wherein said piston and housing define a generally annular volume in communication with said outlet and between said first and second sealing means; and said housing defines a bypass port therein adjacent said second sealing means, said port being sealed from said annular volume when said piston is in said closed position and in communication with said annular volume when said piston is in said open position.

13. The apparatus of claim 11 wherein said first sealing means is on a first outer surface of said piston; and at least a portion of said second sealing means is on a second outer surface of said piston, said first outer surface being larger than said second outer surface such that a differential area, against which said pump discharge pressure acts, is defined therebetween.

14. The apparatus of claim 13 wherein said housing comprises an annular portion adjacent said second outer surface of said piston, said annular portion defining a substantially transverse port therethrough, said port being on an opposite side of said second sealing means from said housing outlet when said piston is in said closed position housing outlet when said piston is in said open position.

15. The apparatus of claim 10 further comprising biasing means for biasing said piston toward said closed position.

16. The apparatus of claim 10 further comprising a flow tube disposed in said mandrel such that an annular volume is defined therebetween in communication with said check valve means.

17. A downhole tool comprising:

a pump;

an inflatable packer disposed below said pump and adapted for inflation thereby; and a pressure limiter disposed between said pump and packer and comprising;

means for bypassing pump discharge pressure to a well annulus above said packer when said pump discharge pressure reaches a predetermined level, said means for bypassing including an annular piston in said pressure limiter and biased toward a closed position, said piston having a differential area thereon against which said pump pressure acts for overcoming a biasing force on said piston when said predetermined level is reached; and means for maintaining said pressure limiter in a bypassing position such that an outlet of said pump is in substantially constant communication with said well annulus until pressure is relieved from said packer, said means for maintaining said pressure limiter in a bypassing position includes a check valve adjacent said piston whereby pressure is maintained on said differential area at a level substantially as high as said predetermined level, even when said pump discharge pressure drops as a result of being bypassed to said well annulus.

18. The method of claim 17 wherein said biasing force is adjustable.

* * * * *